US009101171B2

(12) United States Patent
Brandt et al.

(10) Patent No.: US 9,101,171 B2
(45) Date of Patent: Aug. 11, 2015

(54) MULTI-COMPONENT IMPACT PROTECTION DEVICE FOR ATHLETICS

(71) Applicant: Nike, Inc., Beaverton, OR (US)

(72) Inventors: Baron Carl Brandt, Portland, OR (US); Daniela Grogro, Portland, OR (US); Ryan P. Henry, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 11 days.

(21) Appl. No.: 13/795,547

(22) Filed: Mar. 12, 2013

(65) Prior Publication Data

US 2014/0259323 A1 Sep. 18, 2014

(51) Int. Cl.
*A41D 13/015* (2006.01)

(52) U.S. Cl.
CPC ..... *A41D 13/015* (2013.01)

(58) Field of Classification Search
USPC ..... 2/455, 456, 463.464, 227
See application file for complete search history.

(56) References Cited

U.S. PATENT DOCUMENTS

| | | | | | |
|---|---|---|---|---|---|
| 921,352 | A | * | 5/1909 | Towers | 2/2.5 |
| 1,021,804 | A | * | 4/1912 | Schneider | 160/218 |
| 1,282,411 | A | * | 10/1918 | Golembiowski | 428/51 |
| 1,290,799 | A | | 1/1919 | Talley | |
| 1,915,754 | A | * | 6/1933 | O'Shea | 2/465 |
| 3,746,605 | A | * | 7/1973 | Dillon et al. | 428/159 |
| 3,867,239 | A | * | 2/1975 | Alesi et al. | 428/48 |
| 4,322,858 | A | * | 4/1982 | Douglas | 2/463 |
| 4,377,009 | A | * | 3/1983 | Douglas | 2/411 |
| 4,483,020 | A | * | 11/1984 | Dunn | 2/2.5 |
| 4,546,492 | A | * | 10/1985 | Dickenson | 2/46 |
| 4,633,756 | A | | 1/1987 | Rudoi | |
| 4,648,136 | A | * | 3/1987 | Higuchi | 2/2.5 |
| 4,648,554 | A | * | 3/1987 | McQueen | 238/283 |
| 4,951,689 | A | * | 8/1990 | Jones | 2/161.1 |
| 5,906,873 | A | * | 5/1999 | Kim | 428/57 |
| 6,035,438 | A | * | 3/2000 | Neal et al. | 2/2.5 |
| 6,170,378 | B1 | * | 1/2001 | Neal et al. | 89/36.05 |
| 6,510,777 | B2 | * | 1/2003 | Neal | 89/36.05 |
| 6,953,111 | B2 | * | 10/2005 | Chi | 190/125 |
| 7,082,621 | B1 | * | 8/2006 | Fratesi | 2/227 |
| 7,490,358 | B1 | * | 2/2009 | Beck | 2/2.5 |

(Continued)

FOREIGN PATENT DOCUMENTS

| | | |
|---|---|---|
| EP | 1334667 | 8/2003 |
| EP | 1517111 B1 | 7/2011 |
| WO | 2007078743 | 7/2007 |

OTHER PUBLICATIONS

International Search Report with Written Opinion dated Jul. 11, 2014 in Application No. PCT/US14/21312, 9 pages.

*Primary Examiner* — Richale Quinn
(74) *Attorney, Agent, or Firm* — Shook, Hardy & Bacon L.L.P.

(57) ABSTRACT

A plurality of overlapping protective plates may form a protective device to protect a portion of a wearer's anatomy from impact. Each of the protective plates may have at least one connection point that retains the protective plate in position over the portion of the wearer's anatomy to be protected in an as worn position. The connection points may retain the protective plates to a flexible plate that may be conformed to the portion of the wearer's anatomy to be protected. Alternatively/additionally, the connection points on a protective plate may connect that plate to another protective plate, thereby allowing a structure of interconnected protective plates to be formed.

14 Claims, 7 Drawing Sheets

(56) References Cited

U.S. PATENT DOCUMENTS

| | | | | |
|---|---|---|---|---|
| 7,500,422 | B2 * | 3/2009 | Mazur | 89/36.02 |
| 8,245,842 | B2 | 8/2012 | Bau | |
| 8,336,117 | B2 * | 12/2012 | Carter et al. | 2/87 |
| 8,434,396 | B1 * | 5/2013 | Wiley et al. | 89/36.01 |
| 8,683,618 | B2 * | 4/2014 | Grogro et al. | 2/228 |
| 8,702,895 | B2 * | 4/2014 | Turner | 156/300 |
| 8,713,719 | B2 * | 5/2014 | Turner | 2/456 |
| 2005/0108800 | A1 | 5/2005 | White | |
| 2007/0234458 | A1 | 10/2007 | Larsen, II et al. | |
| 2009/0255022 | A1 | 10/2009 | Smith et al. | |
| 2010/0293703 | A1 | 11/2010 | Tezartes-Strauss | |
| 2013/0036536 | A1 * | 2/2013 | Breindahl et al. | 2/455 |

* cited by examiner

MULTI-COMPONENT IMPACT PROTECTION DEVICE FOR ATHLETICS

CROSS-REFERENCE TO RELATED APPLICATIONS

Not applicable.

FIELD

The present invention relates to athletic safety and injury prevention. More particularly, the present invention relates to an impact protection device to be worn by an athlete participating in a contact sport, such as American football.

SUMMARY

Many sports, such as American football, inherently involve physical contact between players, with the ground, and/or with equipment. Numerous efforts have been made to prevent or at least reduce the occurrence of injuries to players as a result of such contact. Protective equipment such as helmets, shoulder pads, and pads have been used for protecting portions of the body of athletes. Such protective equipment has often been constructed, at least in part, of a compressible material such as foam. These types of equipment have decreased, but not completely eliminated, injuries occurring due to playing and/or practicing contact sports such as American football.

The use of protective equipment has been mandated by various organizations that promulgate the rules of contact sports for participants. Often, the very athletes at risk for injury resist the use of additional protective equipment, whether mandatory or voluntary. While every individual athlete may have his or her own reason for eschewing required or suggested protective gear, common explanations are complaints that the protective gear is uncomfortable, restricts motion, distracts the athlete, or otherwise negatively impacts the athlete's performance.

Accordingly, athletes participating in contact sports with a risk of injury may benefit from improved protective gear that protects the athlete from injury with minimal or no negative impact on the athlete's performance. Such protective gear should be comfortable and permit a full range of movement by the wearer, while still providing sufficient connection from impacts that may typically occur during participation in the sport.

A protective device in accordance with the present invention provides improved impact protection for athletes participating in contact sports such as American football, soccer (world football), hockey, lacrosse, or any other contact sport permitting participants to wear protective gear. A protective device in accordance with the present invention may be particularly suitable for protecting large muscle areas of the wearer from impact, but may be used to protect other portions of a wearer's anatomy without the party from the scope of the present invention. One example of a large muscle area that may be protected using a device in accordance with the present invention are the thighs of an American football player.

A protective device in accordance with the present invention may comprise a plurality of protective plates arranged in an overlapping fashion and retained over the portion of the wearer's anatomy to be protected from impact. Protective plates of a protective device in accordance with the present invention may have a variety of shapes and may be substantially planar, may curve in two dimensions, or may curve in three dimensions. The protective plates may comprise any type of material that can absorb an impact and dissipate the force of that impact across a wider surface area than the impact contact point. Protective plates may be formed of various types of nylon, polypropylene, acrylonitrile butadiene styrene (ABS), and/or other relatively hard, resilient materials. Alternatively, softer compressible materials such as rubber and/or foams may be used. By way of yet further example, protective plates used in a protective device in accordance with the present invention may comprise compressible foams, gels or the like encased in a resilient membrane or shell, which may be made from a nylon, polypropylene, acrylonitrile, butadiene styrene, etc. Further, protective plates used in accordance with the present invention may comprise multiple layers of materials possessing different properties, such as an outward facing hard layer and a skin facing soft layer. Any number of layers may be used in a protective plate in accordance with the present invention. The material used in a protective plate may also vary laterally and/or vertically along the surface of the plate, for example to provide different types and/or degrees of protection at different locations on the wearer's anatomy.

The protective plates retained in an overlapping fashion in a protective device in accordance with the present invention may be retained in a variety of ways. For example, a substrate may provide a plurality of connection points that may mate with corresponding connection points on the protective plates to retain the protective plates in a desired configuration when the substrate conforms to the portion of the wearer's anatomy to be protected. By way of further example, protective plates may have connection points that mate with connection points on other protective plates to permit the protective plates to be assembled and retained in an overlapping fashion over the portion of the wearer's anatomy to be protected. An athletic garment, such as pants or a shirt, may provide pockets that may receive assembled protective plates to facilitate the retention of the overlapping protective plates over the portion of the wearer's anatomy to be protected and to facilitate the overlapping protective plates conformation to the wearer's anatomy.

Overlapping protective plates in accordance with the present invention may further provide ventilation to enhance the comfort and temperature regulation of the wearer. Ventilation may be provided by shaping and/or arranging the protective plates to provide gaps between at least portions of the over lapping protective plates. Additionally/alternatively, openings such as slits, holes, or perforations may be provided within the protective plates themselves to permit the ready flow of air through the protective device formed by the assembled overlapping protective plates.

DRAWINGS

The drawings described herein are for illustrative purposes only of selected

Figure 3A:
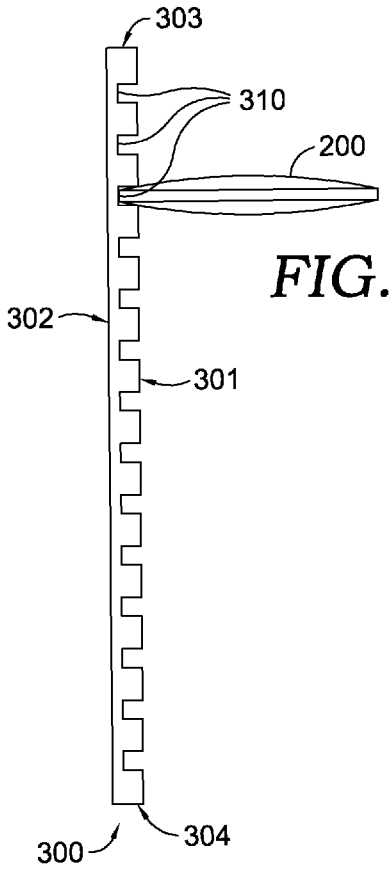
FIG. 3A illustrates an example of a substrate that may retain protective plates in accordance with the present invention.
Figure 3B:
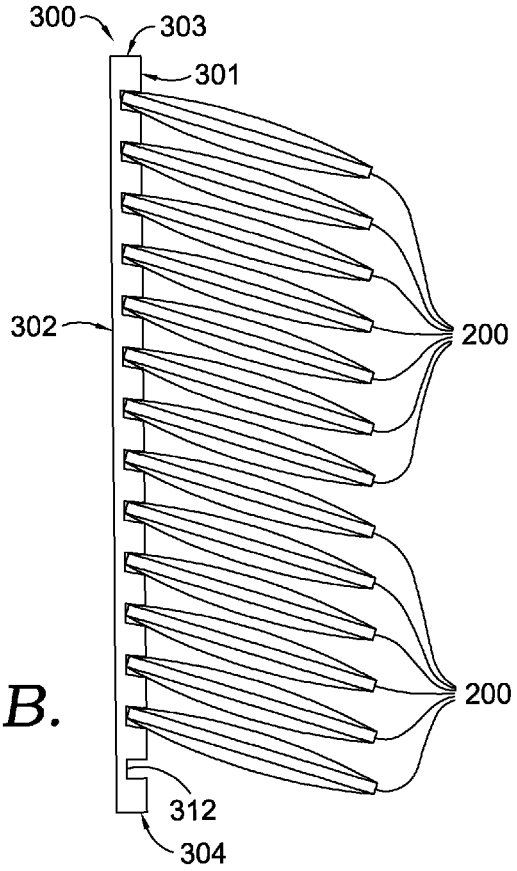
FIG. 3B illustrates an example of a plurality of protective plates retained in an overlapping configuration by a substrate in accordance with the present invention.
Figure 3C:
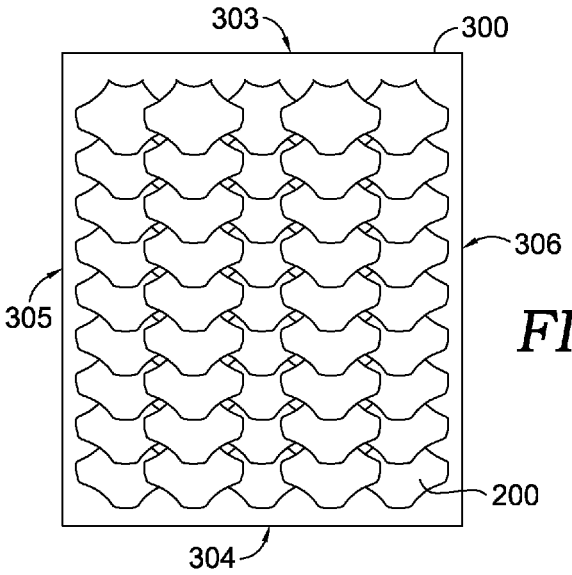
Figure 3D:
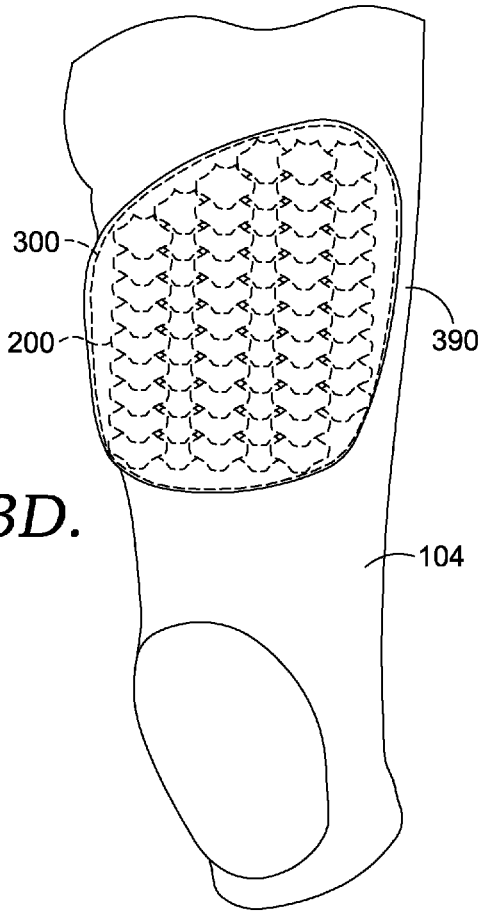
Figure 4:
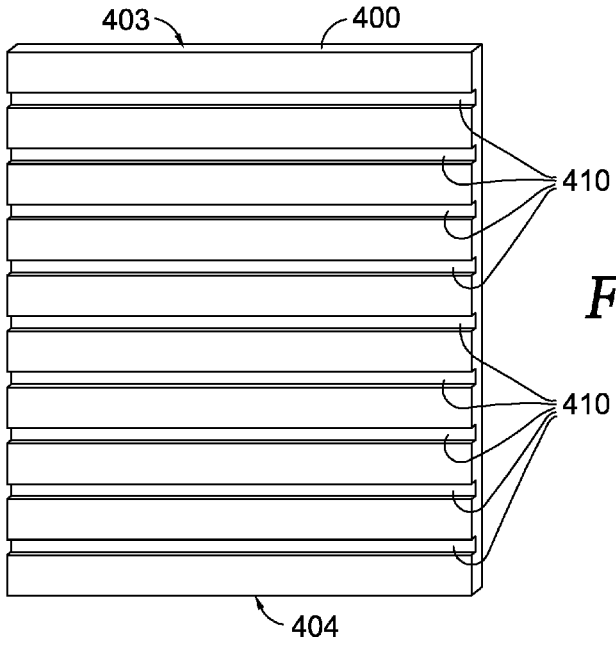
Figure 5:
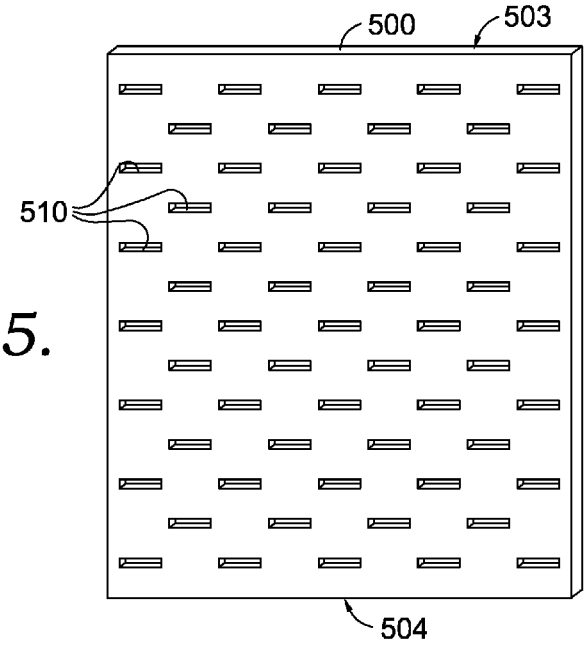
Figure 6A:
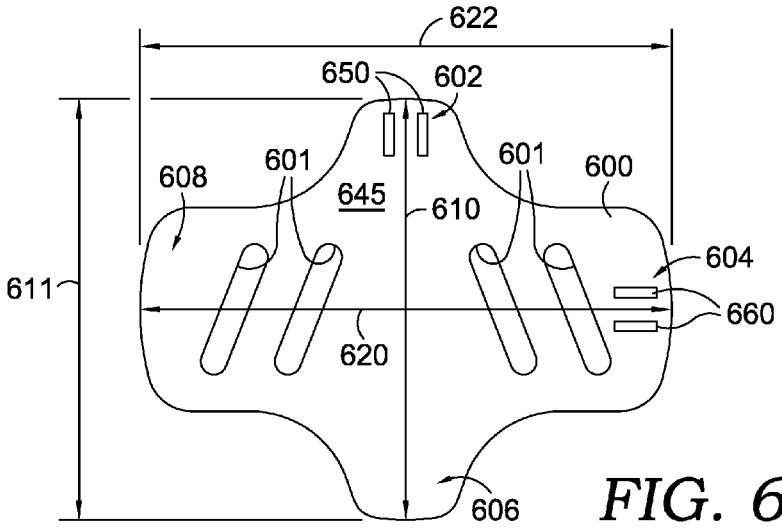
Figure 6B:
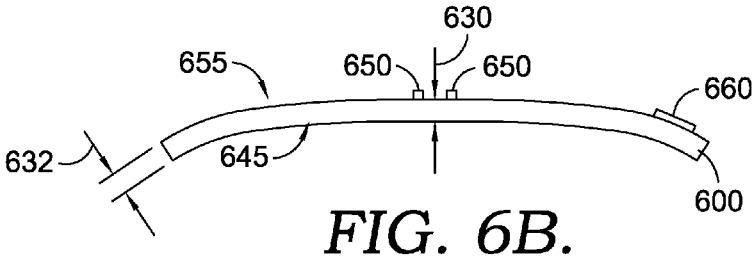
Figure 6C:
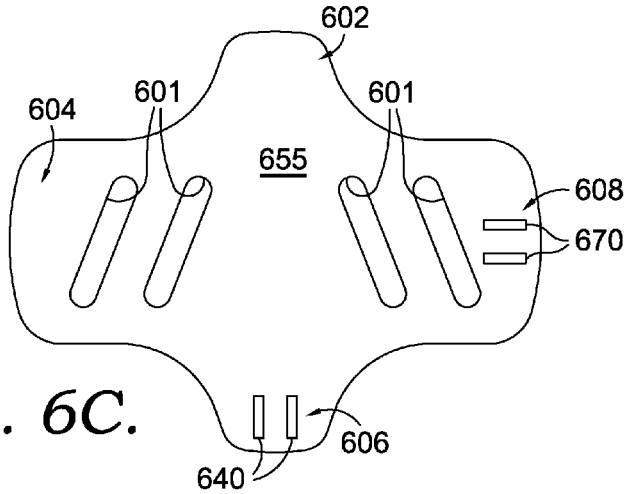
Figure 7:
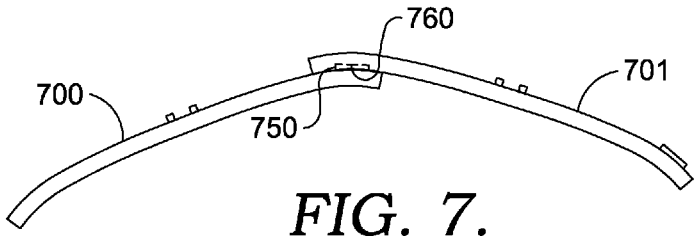
Figure 8:
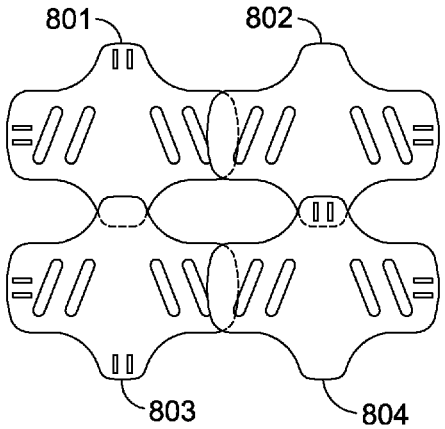
Figure 9:
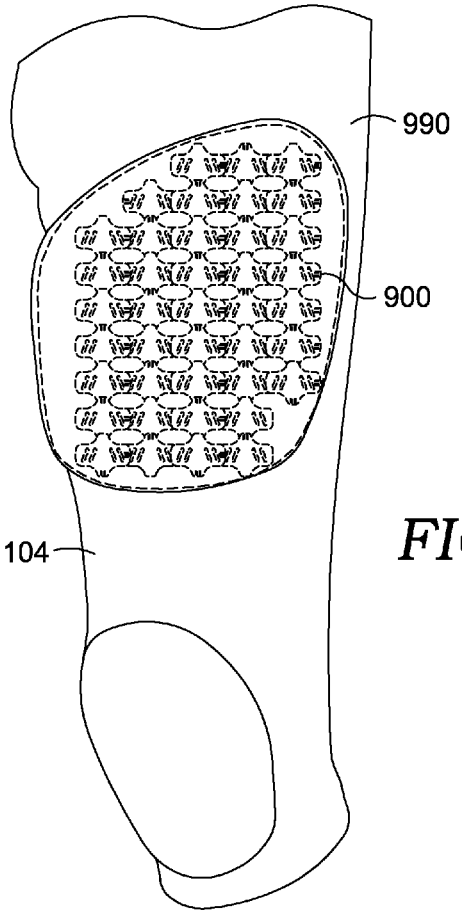

FIG. 3C further illustrates an example of a plurality of protective plates retained in an overlapping configuration by a substrate in accordance with the present invention;

FIG. 3D illustrates an example of protective plates retained in an overlapping configuration by a substrate while worn in accordance with the present invention;

FIG. 4 illustrates an example of a substrate with connection points in accordance with the present invention;

FIG. 5 illustrates a further example of a substrate with connection points in accordance with the present invention;

FIG. 6A illustrates the outward facing side of an additional example of a protective plate in accordance with the present invention;

FIG. 6B illustrates a side view of an additional example of a protective plate in accordance with the present invention;

FIG. 6C illustrates the skin facing side of an additional example of a protective plate in accordance with the present invention;

FIG. 7 illustrates the interconnection of the over lapping protective plates in accordance with the present invention;

FIG. 8 further illustrates an example of overlapping interconnected protective plates in accordance with the present invention; and FIG. 9 illustrates a further example of overlapping protective plates while worn in accordance with the present invention.

DETAILED DESCRIPTION

Figure 1:
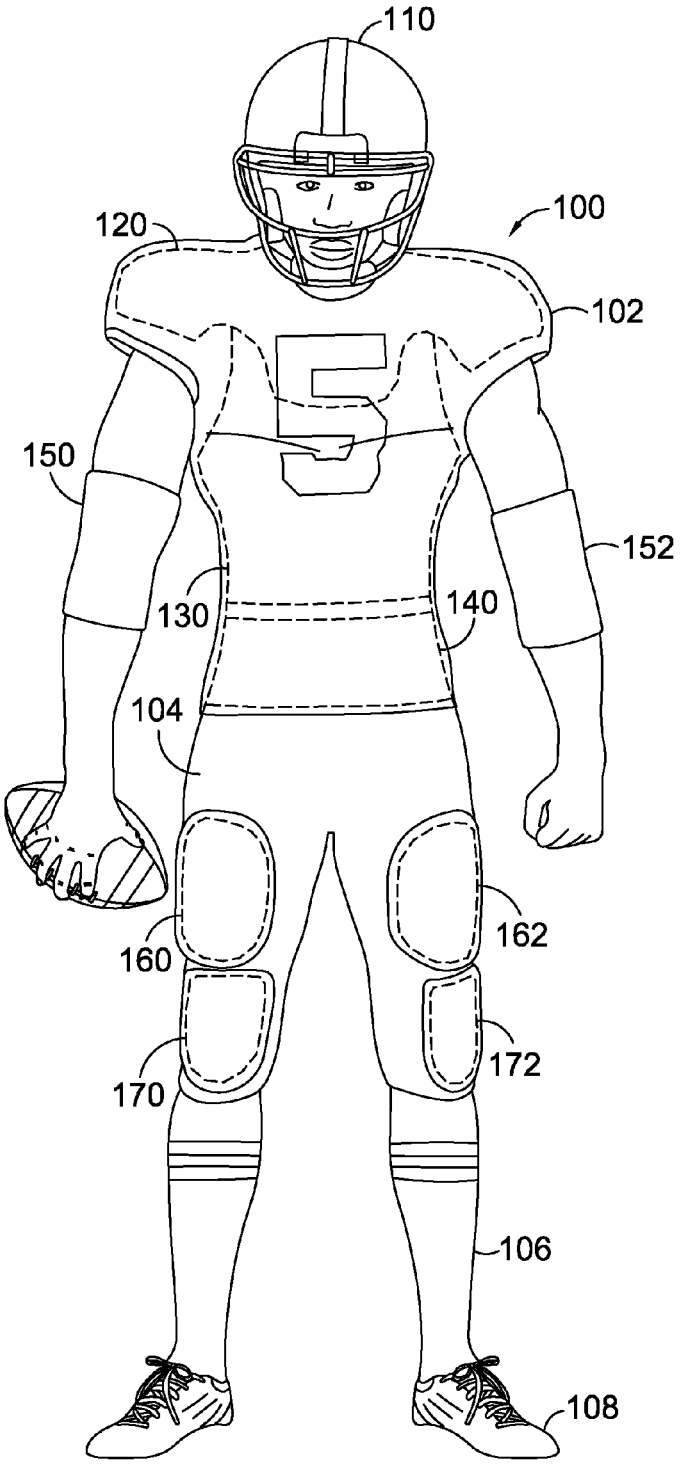
FIG. 1 illustrates a football player that may wear a protective device in accordance with the present invention.

Referring now to FIG. 1, an athlete 100 wearing protective gear is illustrated. In the example shown in FIG. 1, the athlete 100 is an American football player, but athletes participating in any other contact sport may likewise benefit from protective devices in accordance with the present invention. Player 100 is shown wearing a helmet 110 and shoulder pads 120 beneath a jersey 102. In the example shown in FIG. 1, player 100 is also wearing chest protection 130, which may comprise a flak jacket or similar item, and abdominal protection 140 beneath jersey 102. Player is further illustrated wearing a right elbow pad 150 and a left elbow pad 152. Player 100 is also wearing a right thigh pad 160 and a left thigh pad 162 and a right knee pad 170 and a left knee pad 172 beneath pants 104. Pants 104 may have pockets (not shown) on either the outside or, more typically, the inside to retain pads such as thigh pads 160, 162 and knee pads 170, 172. Player 100 is further shown wearing shoes 108 and socks 106. While not currently typical in American football, socks 106 may retain additional pads such as a shin pad (not shown) as more commonly occurs for soccer.

While the example shown in FIG. 1 depicts an American football player 100 wearing specific examples of protective devices, the present invention is not limited to American football or the protective devices illustrated in the present example. Subsequent examples described below provide effective devices that may be used as thigh pads 160, 162, but protective devices in accordance with the present mention may be used in conjunction with other types of protection provided in the example shown in FIG. 1 or to protect portions of the wearer's anatomy other than those shown in the example of FIG. 1.

Figure 2A:
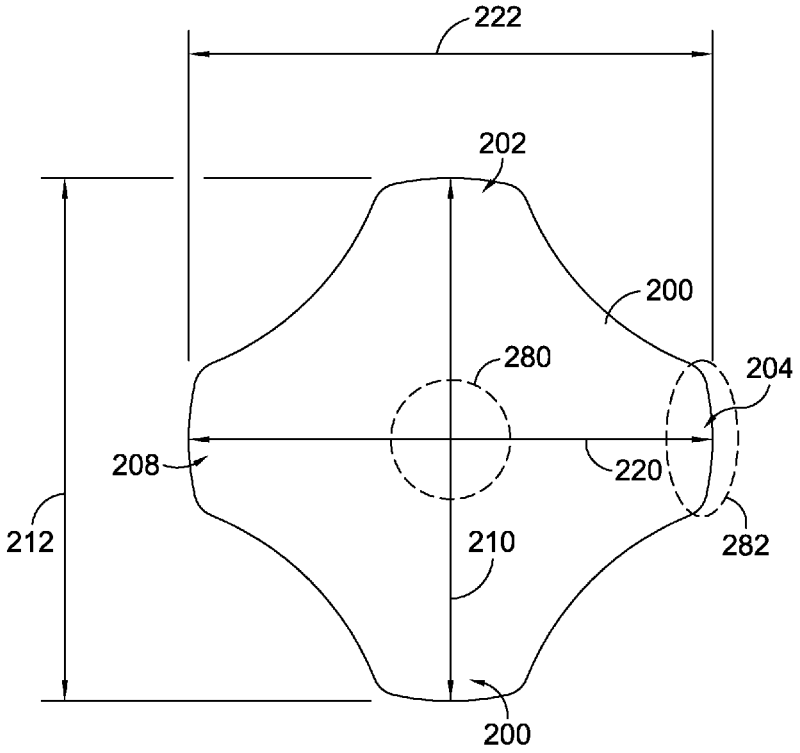
FIG. 2A illustrates an example of a protective plate in accordance with the present invention.

Referring now to FIG. 2A, one example of a protective plate 200 in accordance with the present invention is illustrated. Protective plate 200 may be formed from one or more types of material that may absorb impact force, such as nylons, polypropelene, ABS, rubbers, plastics, gels, layers of materials, etc. Protective plate 200 may have a variety of shapes and need not be planar or symmetrical about any axis. In the example shown in FIG. 2A, however, protective plate 200 is planar and is symmetrical about a first axis 210 and about a second axis 220. Protective plate 200 may have a first length 212 along the first axis 210 and a second length 222 along the second axis 220. Protective plate 200 may have a plurality of potential connection points, such as connection point 202, connection point 204, connection point 206, and connection point 208. While connection points 202, 204, 206, and 208 may provide physical connection structures, they may also/alternatively comprise portions of protective plate 200 that may be interlocked with a connection point on a substrate (described further below) and frictionally retained.

Figure 2B:
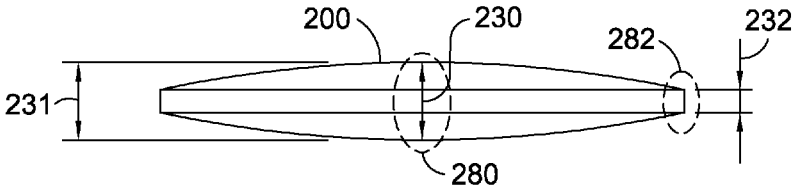
FIG. 2B illustrates a side view of an example of a protective plate in accordance with the present invention.

Referring now to FIG. 2B, a side view of example protective plate 200 is illustrated. In the example shown in FIG. 2B the protective plate 200 has a first thickness 231 across a middle portion 281 and a second thickness 232 across an edge portion 282, causing the protective plate 200 to bulge in its center portion 280. The bulge in the middle portion 280 may provide additional protection and impact absorption, while the thinner edge portions 282 may permit the protective plate 200 to be overlapped with other protective plates without causing the resulting multilayered structure to become uncomfortably thick or cumbersome. In the present example illustrated in FIGS. 2A and 2B protective plate 200 is symmetrical in three dimensions, but no such symmetry is necessary in accordance with the present invention.

Referring now to FIG. 3A, a side view of an example protective plate 200 is shown being inserted into an example substrate 300 that retains one or more protective plates 200. Substrate 300 may have a plurality of connection points 310 that receive a connection point, such as connection point 202, 204, 206, or 208, of a protective plate 200 to retain protective plate 200 in a desired position. Substrate 300 may extend from a first edge 303 (which may be a top edge in an as worn position) and a second edge 304 (which may be a bottom edge in an as worn position). Substrate 300 may also have an inward face 302 that is oriented toward the skin of wearer in an as worn position and an outward face 301 that faces away from the wearer in an as worn position. Inward face 302 may directly contact the skin of the wearer in an as worn position, but also may face the skin of the wearer but be separated from the skin by a textile, sheet, tape, or other type of material in an as worn position. Connection points 310 may be provided in outward face 301 of substrate 300. Substrate 300 may be constructed of a rubber, nylon, non-woven TPU, other polymer, or any other materials that permits a protective plate such as protective plate 200 to be retained by a connection point 310 while still permitting sufficient flexibility for substrate 300 to conform its shape to a portion of the wearer's anatomy, such as a thigh. A substrate 300 may be molded to the approximate shape of the portion of a wearer's anatomy to be protected during fabrication or, alternatively, may be sufficiently pliable to not require molding to a particular shape.

Referring now to FIG. 3B, a cross sectional side view of an example substrate 300 retaining a plurality of protective plates 200 in a plurality of connection points is shown. As can be seen in the example of FIG. 3B, the plurality of protective plates 200 may be retained by a plurality of connection points 310 on the outward face 301 of substrate 300 such that each of the plurality of protective plates 200 extends at an angle downwards (relative to top edge 303) and outward from outward face 301, such that at least some of the protective plates 200 overlaps a portion of another protective plate 200 retained at a lower connection point 310 of the substrate 300. Connection points 310 may possess on orientation that, in combination with a connection point on a protective plate 200, causes the protective plate 200 to extend at any desired angle or orientation relative to outward face 301 of substrate 300. The plurality of protective plates 200 may be rotated relative to connection points 310 during installation or donning. Additionally/alternatively, protective plates 200 may be retained at a desired orientation relative to substrate 300 by being retained within a sleeve or pocket of a garment that is worn by the wearer to position the assembled substrate 300 and protective plates 200 over the portion of the wearer's anatomy to be protected from impact. In such an example, protective plates 200 may be forced downwards from the configuration shown in FIG. 3B for wear. Not all connection points 310 of substrate 310 need be used to retain a protective plate 200 in accordance with the present invention. For example, connection point 312 in the present example has not received a protective plate 200, causing the protective plate retained above retaining point 312 to not overlap another plate from above.

Referring now to FIG. 3C, a front view of an outward side 301 of a substrate 300 retaining a plurality of protective plates 200 is shown after the plurality of protective plates 200 have been forced downwards from the configuration shown in FIG. 3B. Accordingly, the plurality of protective plates 200 extend downwards at an acute angle relative to the anatomy of the wearer in an as worn position. As can be seen in the example of FIG. 3C, protective plates 200 may be retained by connection points 310 of substrate 300 in a fashion that causes protective plates 200 to overlap along a horizontal direction as well as a vertical direction. For example, substrate 300 may have a right edge 305 and a left edge 306 relative to a wearer in an as worn position, with a plurality of protective plates 200 retained by substrate 300 such that at least some of the plurality of protective plates overlap another plate to either the left or right in an as worn position. As discussed above with regard to FIG. 2B, the thickness of different portions of protective plates 200 may be selected such that the overlaps illustrated in FIGS. 3B and 3C do not cause the total thickness of the overlapping protective plates 200 to be uncomfortably thick for the wearer.

Referring now to FIG. 3D, an example of a plurality of protective plates 200 retained in an overlapping fashion by a substrate 300 is shown in phantom while retained within a pocket of pants 104 suitable for American football. While illustrated in the present example of protecting the thigh 390 of an American football player in an as worn position, protective devices of overlapping protective plates may be used to protect other portions of a wearer's anatomy and/or for protection of athletes engaged in sports other than American football.

Referring now to FIG. 4, one example of a substrate 400 with a plurality of grooves 410 serving as connection points to retain protective plates (such as protective plates 200) is shown. In the example of FIG. 4 the grooves 410 are substantially straight and substantially parallel with one another and bottom edge 404 of substrate 400, but other orientations are possible. For example, grooves 410 may be curvilinear, may be oriented in intersecting lines or curves, may have different spacing between individual grooves 410, etc. Grooves 410 may correspond with the thickness of a corresponding connection point of a protective plate (such as one of connection points 202, 204, 206, or 208 of a protective plate 200) in order to form a friction fit to retain a protective plate within groove. For example, groove 410 may be slightly smaller than second thickness 282 of a protective plate 200, such that a connection point 202 of the protective plate 200 is slightly compressed upon insertion into groove 410, thereby retaining protective plate in position.

Referring now to FIG. 5, a further example of a substrate 500 with a plurality of connection points comprising discrete slots 510 is illustrated. Similar to the example of FIG. 4, slots 510 may frictionally retain a protective plate (such as protective plate 200) when the protective plate 200 is inserted into slot 510.

Connection mechanisms beyond the grooves 410 and slots 510 illustrated in the above examples may be used to retain protective plates within a flexible plate in accordance with the present invention. While a friction fit is relatively durable, easy to use, and straight forward to manufacture, other mechanisms such as hook and loop systems, hook and eye systems, snaps, adhesives, welds, and the like may be used as connection points. A connection mechanism may be able to be disengaged to permit the disassembly and reconfiguration of protective plates, but a connection mechanism may not be disengagable once engaged in some examples of the present invention. Further, a substrate such as substrate 400 (or other examples of substrates described elsewhere herein) need not be rectangular, and may instead be irregular or have at least a partially curvilinear perimeter.

FIG. 6A illustrates a further example of a protective plate 600 that may be used to form a protective device in accordance with the present invention. Protective plate 600 may be formed of a nylon, polypropelene, ABS, rubber, plastic, foam, or other material. A protective plate such as protective plate 600 may provide at least one connection point 650 that engages with a connection point on another protective plate, thereby allowing protective plates to be assembled in an overlapping fashion without the use of a substrate to retain the protective plates 600. For example, connection point 650 may comprise ridges that extend from the outward face 645 of protective plate 600. As shown in the example of FIG. 6A, a protective plate may optionally provide a plurality of ventilation openings 601 that permit air flow through protective plate 600. Protective plate may have a height 611 along a first axis 610 and a width 622 along a second axis 620. While the present example protective plate 600 with a top (as worn) extension 602 and a symmetrically corresponding bottom (as worn) extension 606, as well as a right (as worn) extension 604 and a symmetrically corresponding left (as worn) extension 608, a protective plate in accordance with the present invention may have any shape or configuration. In the present example of FIG. 6A, a first connection point 650 comprising a pair of ridges may be located extending from the outward face 645 and a second connection point 660 may comprise a pair of ridges extending from the outward face 645 on the left extension 604.

Referring now to FIG. 6B, an edge view of an example protective plate 600 is shown. As can be seen in FIG. 6B, protective plate 600 may have a curvature selected to conform to the portion of the anatomy to be protected. The curvature of a protective plate may comprise a simple curve or a complex curve in three dimensions while a curved plate is illustrated in the example of protective plate 600 that does not connect to a substrate, other types of protective plates, such as protective plate 200, may provide a curvature while connecting to a substrate. Protective plate 600 may have a thickness 632. Ridges of first connection point 650 and second connection point 660 extend above outward face 645 of protective plate 600. However, slots corresponding to a third connection point 640 and a fourth connection point 670 (shown in FIG. 6C) may not be seen because they extend below inward face 655 of protective plate 600. As explained further below, the shape and size of slots of third connection point 640 and fourth connection point 670 may correspond to the ridges of first connection point 650 and second connection point 660 to permit the slots and ridges of different connection points to mate and retain the plates in an overlapping fashion.

Referring now to FIG. 6C, an inward face 655 of a protective plate 600 is illustrated. As can be seen in the example of FIG. 6C, a third connection point 640 may comprise a pair of slots that extend into inward face 645 on the bottom extension 606 and a fourth connection point 670 may comprise a pair of slots that extend into inward face 645 on a right extension 608. The particular location of connection points used to interconnection protective plates in accordance with the present invention may vary based upon the size and/or shape of the plate, the material used to form the plate, the portion of the wearer's anatomy to be protected by a plurality of protective plates, etc.

Referring now to FIG. 7, a first protective plate 700 connects in an overlapping fashion with a second protective plate 701. First protective plate 700 and second protective plate 701 may both resemble the example protective plate 600 described above, but may have different sizes, shapes, and/or configurations than described above, and need not be identical to one another. First protective plate 700 may have a first connection point 750 that interconnects with a second connection point 760 on second plate. For example, connection point 750 may comprise one or more slot, while connection point 760 may comprise one or more ridge that mates with the one or more slots at connection point 750.

Referring now to FIG. 8, a first protective plate 801, a second protective plate 802, a third protective plate 803, and a fourth protective plate 804 are shown retained together in an overlapping fashion. Any type of connection points may be used to retain protective plates 801, 802, 803, 804 together. While protective plates 801, 802, 803, 804 are shown in this example as having similar sizes and shapes, protective plates having different sizes and/or shapes may be assembled at connection points in accordance with the present invention. Further, more or fewer protective plates than the four illustrated in the example of FIG. 8 may be used in a protective device in accordance with the present invention, and the arrangement and configuration of assembled protective plates may vary from that shown in the example of FIG. 8.

Referring now to FIG. 9, and example of an assembly 900 of protective plates such as protective plate 600 are shown retained within a pocket of pants 104 suitable for wear while playing American football. Assembly 900 may be retained in a pocket of pants 104 to retain assembly over a portion of the anatomy of the wearer, such as thigh 990. Each of the plates in assembly 900 extend at an acute angle relative to the thigh 990 of the wearer in the as worn position shown. An assembly of overlapping protective plates such as assembly 900 may be used to protect other portions of a wearer's anatomy and may be used to provide protection for sports other than American football.

While the examples described herein show a plurality of similarly symmetrical plates used to form a protective device or structure, different sizes and/or shapes of plates that need not be symmetrical may be used for protective devices in accordance with the present invention. Further, anatomical portions other than thighs may be protected by devices in accordance with the present invention, and the present invention may be used for sports other than American football.

What is claimed is:

1. A protective plate structure for protecting a portion of a wearer's anatomy, the protective plate structure comprising:
- a flexible-plate substrate having a plurality of grooves on a first surface; and
- a plurality of impact absorbing plates, each plate of the plurality of impact absorbing plates comprising:
  - a planar portion that extends to a first length and a first width in two dimensions, the planar portion having a first thickness in a third dimension, and
  - a connection point that frictionally engages a groove of the plurality of grooves to retain the plate at an acute angle relative to the flexible-plate substrate, wherein each plate of the plurality of impact absorbing plates is retained to overlap at least one other plate of the plurality of impact absorbing plates.

2. The protective plate structure of claim 1, wherein the flexible-plate substrate further comprises a plurality of slots on the first surface that retain one or more plates.

3. The protective plate structure of claim 1, wherein the plates of the plurality of impact absorbing plates are formed of a nylon.

4. The protective plate structure of claim 1, wherein the plates of the plurality of impact absorbing plates are formed of polypropylene.

5. The protective plate structure of claim 1, wherein the plates of the plurality of impact absorbing plates are formed of acrylonitrile butadiene styrene.

6. The protective plate structure of claim 1, wherein the flexible-plate substrate includes a second surface that generally opposes the first surface and that is molded to include a concave curvature.

7. A protective device for protecting a wearer's anatomy from impact, the protective device comprising:
- a substrate having a plurality of slots in a first surface;
- a plurality of impact-absorbing plates that are coupled to the first surface, wherein each plate of the plurality of impact-absorbing plates includes:
  - a planar portion that extends to a first length and a first width in two dimensions, the planar portion having a first thickness in a third dimension, and
  - a connection point that frictionally engages a slot of the plurality of slots to retain the plate on the flexible-plate substrate, wherein each plate of the plurality of impact-absorbing plates is retained to overlap at least one other plate of the plurality of impact-absorbing plates.

8. The protective device of claim 7, wherein the connection point is rotatably coupled in the slot.

9. The protective device of claim 7, wherein each plate is retained in an acute-angle orientation with respect to the substrate.

10. The protective device of claim 7, wherein the plurality of impact-absorbing plates are made of one of a nylon, polypropylene, and acrylonitrile butadiene.

11. A protective device for protecting a portion of the wearer's anatomy from impact, the protective device comprising:
- a plurality of impact absorbing plates, each of the plurality of impact absorbing plates having a top surface and a bottom surface;
- a plurality of connection points on the top surfaces of the plurality of impact absorbing plates; and
- a plurality of connection points on the bottom surfaces of the plurality of impact absorbing plates, each of the plurality of connection points on the bottom surfaces of the plurality of impact absorbing plates adapted to connect to the connection points on the top surfaces of the impact absorbing plates, the plurality of impact absorbing plates being retained in a partially overlapping fashion, wherein a first plate of the plurality of impact-absorbing plates includes a set of two or more ridges on the top surface, and wherein a second plate of the plurality of impact-absorbing plates includes a set of two or more slots on the bottom surface that mate with the set of two or more ridges to impede rotation of the first plate relative to the second plate.

12. The protective plate structure of claim 11, wherein the plates of the plurality of impact absorbing plates are formed of a nylon.

13. The protective plate structure of claim 11, wherein the plates of the plurality of impact absorbing plates are formed of polypropylene.

14. The protective plate structure of claim 11, wherein the plates of the plurality of impact absorbing plates are formed of acrylonitrile butadiene styrene.

* * * * *